US005205729A

United States Patent [19]

Iwahori

[11] Patent Number: 5,205,729

[45] Date of Patent: Apr. 27, 1993

[54] SAFETY MECHANISM FOR A LIGHTER

[76] Inventor: Masayuki Iwahori, 15-19, Nakada Honmachi, Shizuoka-shi, Shizuoka-ken, Japan

[21] Appl. No.: 879,992

[22] Filed: May 8, 1992

[30] Foreign Application Priority Data

Nov. 1, 1991 [JP] Japan ..... 3-315349

[51] Int. Cl.[5] ..... F23D 11/36

[52] U.S. Cl. ..... 431/153; 431/276

[58] Field of Search ..... 431/153, 276, 277

[56] References Cited

U.S. PATENT DOCUMENTS 4,784,602 11/1988 Nitta ..... 431/153
5,090,893 2/1992 Floriot ..... 431/153
5,125,829 6/1992 McDonough et al. ..... 431/153

FOREIGN PATENT DOCUMENTS 3-501647 4/1991 Japan .

*Primary Examiner*—Carroll B. Dority
*Attorney, Agent, or Firm*—Harrison & Egbert

[57] ABSTRACT

A safety mechanism for a lighter which mechanism makes it difficult for infants or children to create a fire with the lighter. The safety mechanism is simple in construction, reliable and acceptable for the proper user of the lighter. The safety mechanism comprises a lock button for preventing a gas lever from being turned in the direction of raising the gas nozzle, said lock button being disposed on a lighter body under a rear portion of said gas lever, said lock button being movable forward and backward, the rear end of said lock button usually protruding backward from said lighter body, said lock button having a hole, said lock button having a pair of elastic arms protruding forward, said lock button further having an engagement projection at a lower portion thereof, said lighter body being provided with contact walls corresponding to said elastic arms, said lighter body being provided under said lock button with an elastic action member, said action member having an engagement portion corresponding to said engagement projection of said lock button, said gas lever being provided at a rear portion thereof with a downward projection which can be inserted into said hole of said lock button when said lock button has been pushed forward, said gas lever further being provided at a rear portion thereof with a downward protrusion which pushes said action member downward when said downward projection has been inserted into said hole of said lock button.

3 Claims, 3 Drawing Sheets

SAFETY MECHANISM FOR A LIGHTER

BACKGROUND OF THE INVENTION (1) Field of the Invention

The present invention relates to a safety mechanism for a lighter for cigarettes, cigars, etc. More particularly, it relates to a safety mechanism for a lighter which mechanism makes it difficult for infants or children to create a fire with the lighter.

(2) Description of the Prior Art

A lighter designed to make a fire by an easy operation is desirable for the proper user of the lighter. However, such a lighter is very dangerous when it has come into the hands of infants or children who do not recognize the danger of the lighter. Such infants or children may create a fire with the lighter and get burnt or cause an accidental fire.

In view of the above, Japanese Patent Laid-Open Publication No. Hei 3-501647 (PCT/FR89/00339, WO90/00239) provides a safety mechanism which makes it difficult for infants or children to create a fire with a lighter. As shown in FIG. 8, this safety mechanism comprises a gas lever 1 (A lever for pulling up a gas emission nozzle. When the rear portion of the gas lever 1 is pushed downward, the gas emission nozzle is pulled upward thereby and emits gas.) provided in its rear side wall 2 with a horizontal opening 3 having a certain angular range, a notch 4 cut upward into one end of said opening 3, a stop lever 5 horizontally rotatably disposed under said gas lever 1, one end of said stop lever 5 protruding from said opening 3. When the stop lever 5 is in an unlocked position, which is a position under the notch 4 of said opening 3, as shown in FIG. 8 (1), the gas lever 1 is allowed to turn downward. When the stop lever 5 is in a locked position, which is any position in said opening 3 other than said unlocked position, as shown in FIG. 8 (2), the stop lever 5 does not allow the gas lever 1 to turn downward. A spiral spring (not shown) is used as a means for automatically returning the stop lever 5 from the unlocked position to the locked position. In this safety mechanism, the user of the lighter creates a fire when he has turned the stop lever 5 from the locked position to the unlocked position against the force of the spiral spring.

However, the safety mechanism described above has the disadvantages that it is complicated in construction and does not work with sufficient reliability.

BRIEF SUMMARY OF THE INVENTION

It is therefore an object of the invention to provide a safety mechanism for a lighter which mechanism has a simple construction.

It is another object of the invention to provide a safety mechanism for a lighter which mechanism has sufficient reliability of operation.

It is a further object of the invention to provide a safety mechanism for a lighter which mechanism minimizes the possibility that infants or children can create a fire with the lighter and at the same time is acceptable for the proper user of the lighter.

These and other objects have been attained by a safety mechanism for a lighter, which mechanism comprises a lock button for preventing a gas lever from being turned in the direction of raising the gas nozzle, said lock button being disposed on a lighter body under a rear portion of said gas lever, said lock button being movable forward and backward, the rear end of said lock button usually protruding backward from said lighter body, said lock button having a hole, said lock button having a pair of elastic arms protruding forward, said lock button further having an engagement projection at a lower portion thereof, said lighter body being provided with contact walls corresponding to said elastic arms, said lighter body being provided under said lock button with an elastic action member, said action member having an engagement portion corresponding to said engagement projection of said lock button, said gas lever being provided at a rear portion thereof with a downward projection which can be inserted into said hole of said lock button when said lock button has been pushed forward, said gas lever further being provided at a rear portion thereof with a downward protrusion which pushes said action member downward when said downward projection has been inserted into said hole of said lock button.

In a preferred embodiment of the present invention, said elastic arms of the lock button form a shape resembling the letter "U" and said contact walls of the lighter body contact said elastic arms from outside.

In another preferred embodiment of the present invention, said elastic arms of the lock button form a shape resembling the letter "V" and said contact walls of the lighter body contact said elastic arms from inside.

In the specification and claims of the present patent application, "forward" means "toward the left" in FIG. 1, "backward" meaning "toward the right" in FIG. 1, "rear" meaning "right" in FIG. 1.

The operation of the safety mechanism for a lighter according to the present invention will now be described.

When the lighter is not used, the rear end of the lock button protrudes backward from the lighter body. When the lock button is in this state, it is impossible to turn the gas lever in the direction of raising the gas nozzle because the downward projection at the rear portion of the gas lever contacts the lock button. This means that the gas lever is in a locked state. In this state, it is impossible to create a fire with the lighter.

When the lighter is to be used, the lock button is pushed forward against the force of the elastic arms which are in contact with the contact walls. When the lock button has been pushed forward, the engagement projection at a lower portion of the lock button is engaged with the engagement portion of the elastic action member provided on the lighter body and the lock button is locked there. When the lock button is in this position, the downward projection at the rear portion of the gas lever can be inserted into the hole of the lock button. This means that the gas lever is unlocked and can be turned in the direction of raising the gas nozzle. Now it is possible to create a fire by the same operation as in conventional lighters having no safety mechanism. When the gas lever is turned in the direction of raising the gas nozzle in the ingiting operation, the downward projection at the rear portion of the gas lever is inserted into the hole of the lock button and at the same time the downward protrusion of the gas lever pushes the action member downward. When the action member is pushed downward, the engagement projection of the lock button is disengaged from the engagement portion of the action member. Then, the lock button is automatically returned, by the force of the elastic arms in contact with the contact walls, to the original position in which the rear end of the lock button protrudes backward from the lighter body.

Thus, in the lighter having the safety mechanism of the present invention, the gas lever is usually locked. When the lighter is to be used, the gas lever is unlocked by pushing the lock button forward with the thumb for example against the force of the elastic arms and then the igniting operation is made. When the gas lever is turned in the igniting operation, the gas lever is automatically returned to the original locked state. The two-step operation of pushing forward the lock button against the force of the elastic arms and making the same igniting operation as in conventional lighters makes it difficult for infants or children to create a fire with the lighter having the safety mechanism of the present invention.

The safety mechanism for a lighter according to the present invention has a simple construction and sufficient reliability of operation. Furthermore, the safety mechanism of the present invention is acceptable for the proper user of the lighter.

DETAILED DESCRIPTION

The present invention will now be described in detail with reference to the attached drawings.

Figure 1:
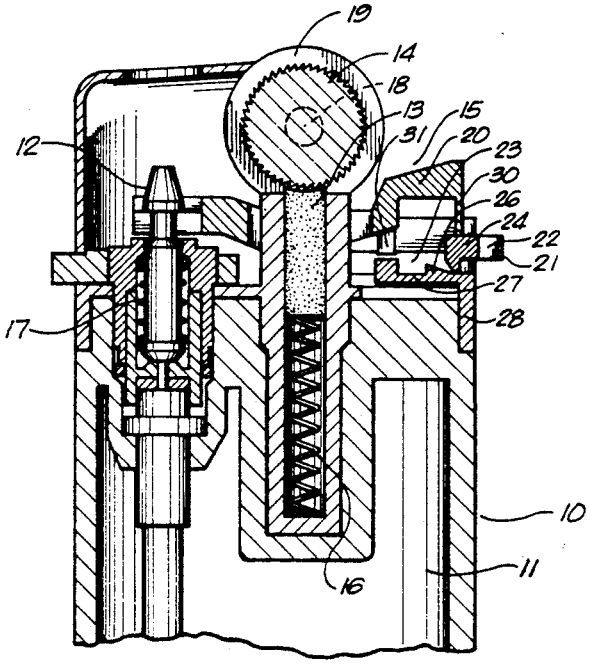
FIG. 1 is a sectional view of a lighter having a safety mechanism according to an embodiment of the present invention, in which a gas lever is locked.

A lighter in which a safety mechanism of the present invention is incorporated will be described first with reference to FIG. 1. This lighter comprises a lighter body 10, a fuel well 11 disposed within said lighter body 10, a gas nozzle 12 through which fuel in said fuel well 11 is emitted, a flint 13, a striker wheel 14 in contact with said flint 13, a gas lever 15 for raising said gas nozzle 12 to emit fuel, a compression spring 16 pushing said flint 13 upward against said striker wheel 14, and a return spring 17 for returning said gas nozzle 12 from a raised position. Reference numeral 18 represents a shaft of the striker wheel 14, and reference numeral 19 represents an auxiliary wheel provided on each of the two sides of said striker wheel 14. The lighter described above makes a fire if the striker wheel 14 is rotated by rotating the auxiliary wheels 19 with the thumb for example and almost simultaneously the rear portion 20 of the gas lever 15 is pushed downward with the same thumb. Then, sparks are emitted by the friction between the flint 13 and the striker wheel 14 and fuel is emitted through the gas nozzle 12 raised by the gas level 15. Therefore, the fuel catches fire.

Now a safety mechanism of the present invention incorporated in the lighter mentioned above will be described.

A lock button 21 for preventing said gas lever 15 from being turned in the direction of raising the gas nozzle 12 is disposed on the lighter body 10 under a rear portion 20 of the gas lever 15. The lock button 21 is movable forward and backward. The rear end of the lock button 21 usually protrudes backward from the lighter body 10. The lock button 21 has a hole 22. The lock button 21 has a pair of elastic arms **23*a* protruding forward, said lock button 21 further having an engagement projection 24 at a lower portion thereof. The elastic arms 23*a* and the engagement projection 24 are preferably made of a synthetic resin in one body with the lock button 21. The lighter body 10 is provided with contact walls 25 corresponding to the elastic arms 23*a*. The lighter body 10 is provided under the lock button 21 with an elastic action member 27 which has an engagement portion 26 corresponding to said engagement projection 24 of the lock button 21. The action member 27 is preferably formed in one body with a lighter body component member 28. The action member 27 is slightly tilted downward when it receives a force from above. The action member 27 returns to its original position by itself when the force from above is removed. The gas lever 15 is provided at the rear portion 20 thereof with a downward projection 30 which can be inserted into said hole 22 of the lock button 21 when the lock button 21 has been pushed forward. The gas lever 15 is further provided at the rear portion 20 thereof with a downward protrusion 31 which pushes the action member 27 downward when said downward projection 30 has been inserted into said hole 22 of the lock button 21**.

Figure 4:
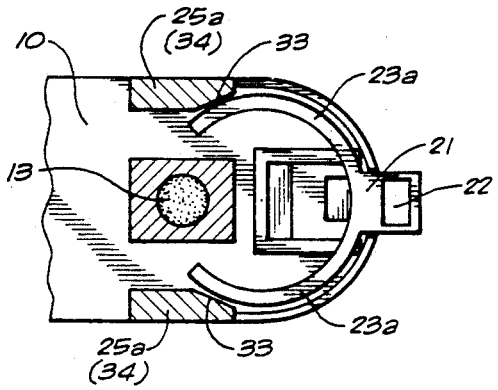
FIG. 4 is a partially sectional plan view of said lighter, in which the gas lever is locked.
Figure 5:
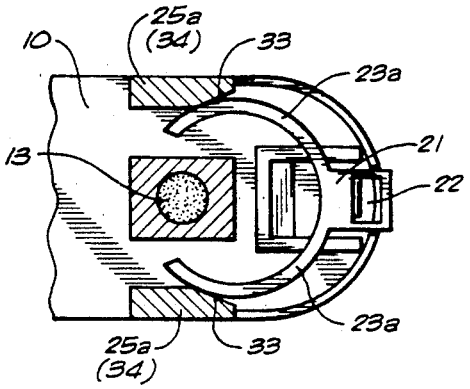
FIG. 5 is a partially sectional plan view of said lighter, in which the gas lever is unlocked.
Figure 6A:
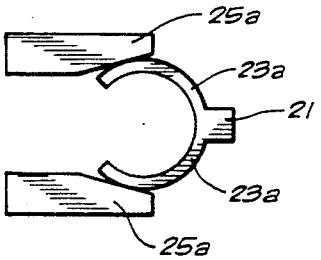
FIG. 6(1) and FIG. 6(2) are schematic plan views illustrating the relationship between the elastic arms of a lock button and contact walls in said lighter.
Figure 6B:
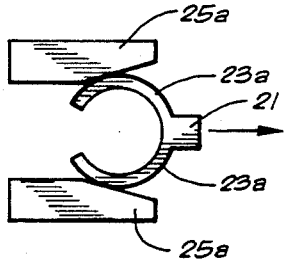

A further description will be given of said elastic arms **23*a* of the lock button 21 and said contact walls 25*a* on the lighter body. In an embodiment shown in FIGS. 4 to 6, elastic arms 23*a* form a shape resembling the letter "U" and contact walls 25*a* contact the elastic arms 23*a* from outside. Each of the contact walls 25*a* comprises an inclined surface 33 formed on a striker stay 34. Each of said elastic arms 23*a* contacts each of said inclined surfaces 33. The elastic arms 23*a* are usually in a state shown in FIG. 6(1). When the lock button 21 is pushed forward and the elastic arms 23*a* are pressed against the contact walls 25*a* on the outside as shown in FIG. 6(2), the elastic arms 23*a* give the lock button 21** a force to move backward.

Figure 7A:
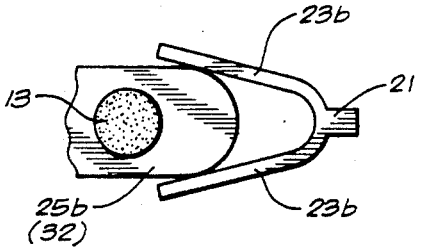
FIG. 7(1) and FIG. 7(2) are schematic plan views illustrating the relationship between the elastic arms of a lock button and contact walls in another embodiment of the present invention.
Figure 7B:
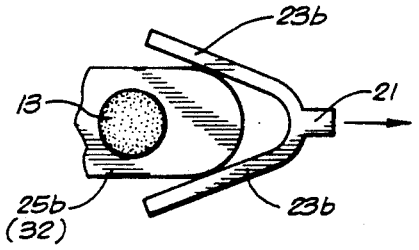
Figure 8A:
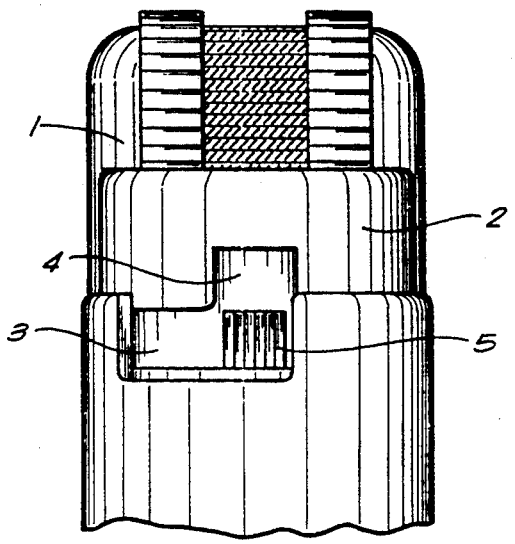
FIG. 8(1) and FIG. 8(2) are rear views showing a conventional safety mechanism.
Figure 8B:
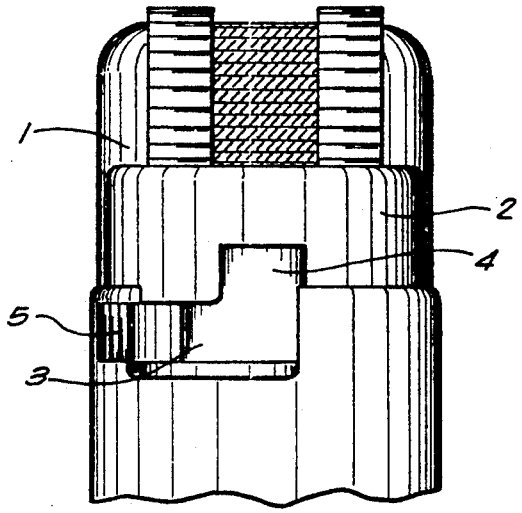

In an embodiment shown in FIG. 7, elastic arms **23*b* form a shape resembling the letter "V" and contact walls 25*b* contact the elastic arms 23*b* from inside. The contact walls 25*b* in FIG. 7 are part of a flint support 32. The elastic arms 23*b* are usually in a state shown in FIG. 7(1). When the lock button 21 is pushed forward and the elastic arms 23*b* are pressed against the contact walls 25*b* on the inside as shown in FIG. 7(2), the elastic arms 23*b* give the lock button 21** a force to move backward.

The state of the gas lever 15 will be described further with reference to the relationship between the lock button 21 and the action member 27.

Locked State

This is a normal state in which the lighter is not used. The rear end of the lock button 21 protrudes backward from the lighter body 18. When the lock button 21 is in this state, it is impossible to turn the gas lever 15 in the direction of raising the gas nozzle 12 because the downward projection 30 at the rear portion of the gas lever 15 contacts the lock button 21. Therefore, it is impossible to create a fire with the lighter. See FIG. 1, FIG. 4, FIG. 6(1) and FIG. 7(1).

Unlocked State

Figure 2:
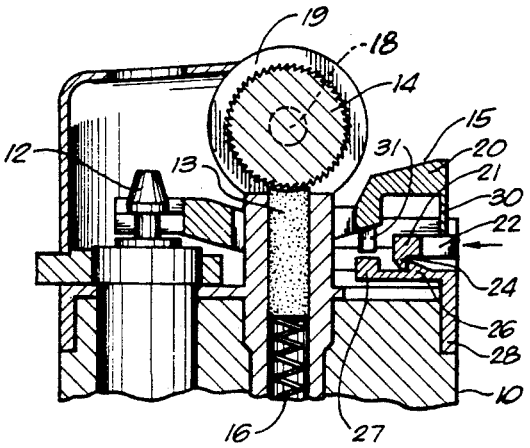
FIG. 2 is a sectional view of said lighter, in which the gas lever is unlocked.

This is a state in which the lighter is used. This state can be obtained by pushing forward the lock button 21 against the force of the elastic arms 23 in contact with the contact walls 25. When the lock button 21 has been pushed forward, the engagement projection 24 at the lower portion of the lock button 21 is engaged with the engagement portion 26 of the elastic action member 27 on the lighter body 10 and the lock button 21 is locked thereby in the forward position. When the lock button 21 is in this position, the downward projection 30 at the rear portion of the gas lever 15 can be inserted into the hole 22 of the lock button 21. This means that the gas lever 15 is unlocked and can be turned in the direction of raising the gas nozzle 12. Therefore, it is possible to create a fire with the lighter. See FIG. 2, FIG. 5, FIG. 6(2) and FIG. 7(2).

Ignition

Figure 3:
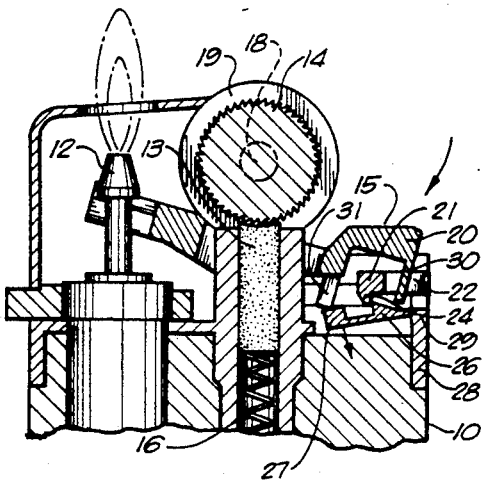
FIG. 3 is a sectional view of said lighter, in which an igniting operation is being made.

When the gas lever 15 is in said unlocked state, the lighter makes a fire if the striker wheel 14 is rotated by rotating the auxiliary wheels 19 with the thumb for example and almost simultaneously the rear portion 20 of the gas lever 15 is pushed downward with the same thumb. This igniting operation is the same as in conventional lighters having no safety mechanism. See FIG. 3.

Automatic Return to Locked State

When the gas lever 15 is turned in the direction of raising the gas nozzle 12 in the igniting operation by pushing downward the rear portion 20 of the gas lever 15, the downward projection 30 at the rear portion of the gas lever 15 is inserted into the hole 22 of the lock button 21 and at the same time the downward protrusion 31 of the gas lever 15 pushes the action member 27 downward. When the action member 27 has been pushed downward, the engagement portion 26 of the action member 27 is disengaged from the engagement projection 24 of the lock button 21 and the engagement between the lock button 21 and the action member 27 is released thereby. Then the lock button 21 is automatically returned to the original position by the force of the elastic arms 23 in pressing contact with the contact walls 25. See FIG. 3, FIG. 6(2) and FIG. 7(2).

What is claimed is:

1. A safety mechanism for a lighter comprising a lock button for preventing a gas lever from being turned in the direction of raising the gas nozzle, said lock button being disposed on a lighter body under a rear portion of said gas lever, said lock button being movable forward and backward, the rear end of said lock button usually protruding backward from said lighter body, said lock button having a hole, said lock button having a pair of elastic arms protruding forward, said lock button further having an engagement projection at a lower portion thereof, said lighter body being provided with contact walls corresponding to said elastic arms, said lighter body being provided under said lock button with an elastic action member, said action member having an engagement portion corresponding to said engagement projection of said lock button, said gas lever being provided at a rear portion thereof with a downward projection which can be inserted into said hole of said lock button when said lock button has been pushed forward, said gas lever further being provided at a rear portion thereof with a downward protrusion which pushes said action member downward when said downward projection has been inserted into said hole of said lock button.

2. A safety mechanism for a lighter as claimed in claim 1, wherein said elastic arms of said lock button form a shape resembling the letter "U" and said contact walls of said lighter body contact said elastic arms from outside.

3. A safety mechanism for a lighter as claimed in claim 1, wherein said elastic arms of said lock button form a shape resembling the letter "V" and said contact walls of said lighter body contact said elastic arms from inside.

* * * * *